US008346154B2

(12) United States Patent
Hara et al.

(10) Patent No.: US 8,346,154 B2
(45) Date of Patent: Jan. 1, 2013

(54) TRANSFER CONTROL MECHANISM FOR PRINTER AND TRANSFER CONTROL METHOD

(75) Inventors: Masashi Hara, Ibaraki-ken (JP); Yukihiro Maeda, Ibaraki-ken (JP); Masatoshi Fujimoto, Ibaraki-ken (JP); Masakazu Kawano, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 425 days.

(21) Appl. No.: 12/585,821

(22) Filed: Sep. 25, 2009

(65) Prior Publication Data

US 2010/0086338 A1 Apr. 8, 2010

(30) Foreign Application Priority Data

Oct. 2, 2008 (JP) ..... P2008-257778

Dec. 4, 2008 (JP) ..... P2008-309928

(51) Int. Cl.
*G03G 15/00* (2006.01)

(52) U.S. Cl. ..... 399/406; 399/18; 399/21; 399/397; 399/405; 399/66

(58) Field of Classification Search ..... 399/18, 399/21, 388, 406, 66, 317, 397, 405; 347/220
See application file for complete search history.

(56) References Cited

U.S. PATENT DOCUMENTS

| | | | | |
|---|---|---|---|---|
| 6,668,155 | B1 * | 12/2003 | Hubble et al. | 399/406 |
| 7,085,504 | B2 * | 8/2006 | Matsuyama et al. | 399/21 |
| 2005/0111860 | A1 * | 5/2005 | Park | 399/18 |
| 2008/0019751 | A1 * | 1/2008 | Castillo et al. | 399/406 |

FOREIGN PATENT DOCUMENTS

| | | | |
|---|---|---|---|
| JP | 09-114156 | A | 5/1997 |
| JP | 2002-137849 | A | 5/2002 |
| JP | 2006054665 | A | 5/2006 |
| JP | 2007-136726 | A | 6/2007 |
| JP | 2007-145504 | A | 6/2007 |

OTHER PUBLICATIONS

Office Action issued on Sep. 18, 2012 in the counterpart Japanese Application.

* cited by examiner

*Primary Examiner* — Matthew G Marini
(74) *Attorney, Agent, or Firm* — Nath, Goldberg & Meyer; Jerald L. Meyer

(57) ABSTRACT

A conveyance control mechanism for a printer including an image forming unit forming an image on a sheet being conveyed on a conveyance route, includes a curl detector configured to detect a curl of the sheet conveyed on the conveyance route, in an upstream of the image forming unit on the conveyance route. The conveyance route controller may drive and stop the conveyance route differently depending on whether the curl detector detects a curl at either a front end or at a position other than the front end. When the curl detector detects a curl of the sheet, an image forming route where the image forming unit performs an image formation may be separated and retreated from the conveyance route and the sheet being conveyed may be discharged onto the retreated image forming route.

6 Claims, 10 Drawing Sheets

TRANSFER CONTROL MECHANISM FOR PRINTER AND TRANSFER CONTROL METHOD

CROSS REFERENCE TO RELATED APPLICATION

This application is based upon and claims the benefit of priority from the prior Japanese Patent Application No. 2008-257778 filed on Oct. 2, 2008 and the prior Japanese Patent Application No. 2008-309928 filed on Dec. 4, 2008, the entire contents of which are incorporated herein by reference.

BACKGROUND OF THE INVENTION

1. Field of the Invention

The present invention relates to a conveyance control mechanism for a printer provided with an image forming unit configured to form an image on a surface of a sheet conveyed on a conveyance route, and relates to a conveyance control method.

2. Description of the Related Art

In general, in order to record an image on a sheet, an inkjet-type image forming apparatus constantly needs to maintain an interval between a sheet and multiple recording nozzles of a printing head at an optimum distance for recording.

A sheet may often curl above a sheet conveyance unit. If a sheet curls considerably upward, the interval between the sheet and a recording head deviates from a preset interval, thereby causing a failure in recording on the sheet according to the settings. In some other cases, the sheet may strike against the recording head and may damage the recording head as a consequence.

Meanwhile, image forming processes at higher speed has been demanded for image forming apparatuses in recent years. To meet this demand, an image forming apparatus continuously feeds numerous sheets from a paper feeder at short intervals when continuously performing image forming processes on the numerous sheets.

In such an image forming apparatus configured to perform an image forming process at high speed, a process to stop a whole of printing and conveyance operations is carried out when a sheet is jammed somewhere on a conveyance route. Accordingly, the apparatus stops operating while having numerous sheets on the conveyance route. Removal of all the sheets on the conveyance route at the time of a jam release operation for a jammed sheet complicates the jam release operation, and also causes a waste of recourses because numerous usable sheets are wastefully discarded.

To address this situation, Japanese Patent Application Publication No. 2002-137849 discloses a technique in which, when a sheet is jammed somewhere on a conveyance route, all the completely-recorded sheets that are being conveyed on a downstream side of the jammed sheet in a conveyance direction are discharged.

Here, a sheet in conveyance may be curled not only at its front end but also at its tail end. In this case, if a curl of the sheet is detected at the front end thereof, the printing is not performed on the sheet. Instead, if a curl of the sheet is detected at the tail end thereof, the printing has already been started on the sheet from the front end in some cases. In the latter case, if a belt platen continues the operation to convey the sheet, a recording head may be damaged.

Regardless of whether the curl occurs at the front end or at the tail end of the sheet, however, all the sheets are transmitted through the conveyance route on the downstream side in the conveyance direction and discharged onto a discharge tray according to the technique disclosed in Japanese Patent Application Publication No. 2002-137849. Therefore, the curled sheet also passes through a belt platen unit and thereby may damage a recording head. Moreover, since sheets correctly printed and sheets printed only partly are discharged onto the same discharge tray, a user needs to carry out a cumbersome operation later for removing the sheets printed only partly. Such an operation puts a heavy burden on the user.

Meanwhile, as a method of automatically reversing print sheets in a printer configured to perform both side printing, there has been widely used a method in which the printer is provided with a switchback route in the course of a route for circulating print sheets, and thereby is configured to reverse the front and back surfaces of a print sheet by performing switchback of the print sheet on the switchback route.

However, a print sheet may be retained in the switchback mechanism at the time of an emergency stop due to occurrence of a sheet jam. In this case, the above-described technique disclosed in Japanese Patent Application Publication No. 2002-137849 does not allow the print sheet to be completely discharged from the switchback route. Therefore, the user has to remove the print sheet. In addition, due to complexity of the switchback mechanism, the operation to remove the jammed sheet is even more complicated and leads to an increase of the burden on the user.

SUMMARY OF THE INVENTION

The present invention has been made in view of the foregoing problems and an object thereof is to provide a conveyance control mechanism for a printer and a conveyance control method which are capable of preventing a sheet from striking against a recording head by detecting a curl of the sheet at a front end as well as a position other than the front end of the sheet and also capable of facilitating a jam release operation executed by a user when a printed medium is jammed on a conveyance route.

Additionally, the present invention has been made in view of the foregoing problems and another object thereof is to provide a conveyance control mechanism for a printer and a conveyance control method which are capable of reducing as much as possible the possibility of damaging a recording head in an image forming unit at the time of sheet trouble and also capable of facilitating an operation to remove a sheet retained on a conveyance route.

To achieve the object, a first aspect of the invention is a conveyance control mechanism for a printer provided with an image forming unit configured to form an image on a sheet being conveyed on a conveyance route, the conveyance control mechanism comprising: a curl detector configured to detect a curl at either of a front end and a position other than the front end of a sheet in conveyance on the conveyance route, in an upstream of the image forming unit on the conveyance route; and a conveyance route controller configured to control drive and stop of the conveyance route, the conveyance route controller configured to drive and stop the conveyance route differently depending on whether the curl detector detects the curl at the front end of the sheet or at the position other than the front end of the sheet.

According to the first aspect, a driven part and a stopped part on the conveyance route are changed depending on whether the curl of the sheet detected by the curl detector is located at a front end or a position other than the front end (such as a tail end, a side end or looseness inside the sheet). Therefore, it is possible to prevent the image forming unit and the curled sheet from coming into contact with each other and thereby to protect the recording head and the like. As a result, according to the present invention, it is possible to deal with various circumstances. For example, the printed sheets are discharged to a usual discharge tray through a downstream-side conveyance route to prevent printed sheets from being wasted, or as to unprinted sheets, a printing process is brought to an emergency stop or the unprinted sheets are retreated into another route or the like to preferentially protect the recording head.

When the curl detector detects the curl at the front end of the sheet, the conveyance route controller may stop urgently a paper feed mechanism configured to feed sheets to the conveyance route and continuously convey a sheet being already in conveyance on the conveyance route.

According to the above-described configuration, it is possible to preferentially prevent the recording head of the image forming unit from being damaged by an emergency stop of the paper feed mechanism when the curl detector detects the curl on the front end of the unprinted sheet. Meanwhile, it is possible to discharge the printed sheet, which is currently being printed, located on an image forming route and the sheet, which has been already printed, located on the downstream-side conveyance route through the conveyance route. Hence, it is possible to prevent the sheets from being wasted.

The conveyance control mechanism may further comprise: a retreat mechanism configured to separate and retreat an image forming route from the conveyance route, the image forming route being included in the conveyance route and being a place where the image forming unit performs an image formation. And when the curl detector detects the curl at a position other than the front end of the sheet, the conveyance route controller may stop conveyance drive of the image forming route and drive the retreat mechanism to retreat the image forming route.

According to the above-described configuration, when the curl detector detects the curl at a position other than a front end of a sheet, since the sheet on the image forming route of which the curl is detected is in progress of a printing process, the unprinted sheet is separated away from the image forming unit together with the image forming route by using the retreat mechanism. Therefore, it is possible to prevent the sheet from coming into contact with and damaging the recording head located on the image forming unit.

To achieve the object, a second aspect of the invention is a conveyance control method for a printer provided with an image forming unit configured to form an image on a sheet being conveyed on a conveyance route, the method comprising: detecting a curl at either a front end and a position other than the front end of a sheet in conveyance on the conveyance route, in an upstream of the image forming unit on the conveyance route; and driving and stopping the conveyance route differently depending on whether the curl is detected in the step of detecting a curl at the front end of the sheet or at the position other than the front end.

According to the second aspect, a driven part and a stopped part on the conveyance route are changed in the step of driving and stopping the conveyance route corresponding to the difference whether the curl of the sheet detected in the step of detecting a curl is located at the front end or a position other than the front end. This can prevent the recording head and the curled sheet from coming into contact with each other and thus can protect the recording head. Moreover, it is possible to deal with various circumstances. For example, the printed sheets are discharged to a usual discharge tray through the downstream-side conveyance route to prevent printed sheets from being wasted, or as to unprinted sheets, a printing process is brought to an emergency stop or the unprinted sheets are retreated into another route or the like to preferentially protect the recording head.

In the step of driving and stopping the conveyance route, a paper feed mechanism configured to feed sheets to the conveyance route may be stopped urgently and a sheet being already in conveyance on the conveyance route may be continuously conveyed when the curl is detected at the front end of the sheet in the step of detecting a curl.

According to the above-described configuration, it is possible to preferentially prevent the unprinted sheets from damaging the recording head of the image forming unit by an emergency stop of the paper feed mechanism when the curl is detected on the front end of the sheet in the step of detecting a curl. Meanwhile, it is possible to discharge the printed sheet, which is currently being printed, located on the image forming route and the sheet, which has been already printed, located on the downstream-side conveyance route through the conveyance route. Hence, it is possible to prevent the sheets from being wasted.

In the step of driving and stopping the conveyance route, conveyance drive of an image forming route which is included in the conveyance route and is a place where the image forming unit performs an image formation may be stopped, and the image forming route may be separated and retreated from the conveyance route by a retreat mechanism provided on the image forming route, when the curl is detected at a position other than the front end of the sheet in the step of detecting a curl.

According to the above-described configuration, when the curl is detected at a position other than the front end of the sheet in the step of detecting a curl, since the sheet on the image forming route of which the curl is detected is in progress of the printing process, the unprinted sheet is separated from the image forming unit together with the image forming route by using the retreat mechanism to prevent the sheet from coming into contact with and damaging the recording head located on the image forming unit.

To achieve the object, a third aspect of the invention is a conveyance control mechanism for a printer provided with an image forming unit configured to form an image on a sheet being conveyed on a conveyance route, the conveyance control mechanism comprising: a curl detector configured to detect a curl of a sheet in conveyance on the conveyance route, in an upstream of the image forming unit on the conveyance route; an image forming route included in the conveyance route, the image forming route being a place where the image forming unit performs an image formation; a retreat mechanism configured to separate and retreat the image forming route from the conveyance route; and a discharge controller configured to switch a sheet discharge process for a sheet in conveyance on the conveyance route, the discharge controller configured to drive the retreat mechanism to retreat the image forming route and discharge a sheet in conveyance onto the retreated image forming route, when the curl detector detects the curl of the sheet.

According to the third aspect, when the curl detector detects the curl of the sheet, the image forming route is separated from the conveyance route by using the retreat mechanism. Hence it is possible to collect the sheets on the conveyance route onto the image forming route and thereby to remove the sheets collectively. Moreover, it is possible to prevent the sheets from striking against the recording head and the like located in the image forming unit and thereby to prevent damages of the recording head.

The curl detector may be configured to detect overlapped feed of sheets, and the discharge controller may drive the retreat mechanism to retreat the image forming route when overlapped feed of sheets is detected by the curl detector.

According to the above-described configuration, the curl detector can also detect overlapped feed of sheets. Hence it is possible to prevent the sheet from striking against the recording head and the like due to overlapped feed of sheets and thereby to prevent damages of the recording head.

The conveyance control mechanism may further comprise: a conveyance route controller configured to control drive and stop of the conveyance route. And the conveyance route may include: a common conveyance route continuing from a feeding route for feeding a sheet to a discharging route via the image forming unit; and a switchback route branched off and connected to the common conveyance route, the switchback route configured to reverse front and back surfaces of a sheet by receiving the sheet from the common conveyance route, reciprocating the sheet, and returning the sheet to the common conveyance route. And when the retreat mechanism retreats the image forming route, the conveyance route controller may discharge a sheet existed inside the switchback route onto the retreated image forming route.

According to the above-described configuration, when a sheet trouble occurs in a printing machine having a switchback route, sheets retaining inside the switchback route are conveyed to the image forming route by the conveyance route controller, whereby the sheets can be collected on the image forming route by using the retreat mechanism. Hence it is possible to easily remove the sheets that retain on the switchback route having a complicated mechanism.

To achieve the object, a fourth aspect of the invention is a conveyance control method for a printer provided with an image forming unit configured to form an image on a sheet being conveyed on a conveyance route, the method comprising: detecting a curl of a sheet in conveyance on the conveyance route, in an upstream of the image forming unit on the conveyance route; and when the curl of the sheet is detected in the step of detecting a curl, separating and retreating an image forming route from the conveyance route, and discharging a sheet in conveyance onto the retreated image forming route, the image forming route being included in the conveyance route and being a place where the image forming unit performs an image formation.

According to the fourth aspect, when the curl of the sheet is detected in the step of detecting a curl, the image forming route is separated from the conveyance route by using the retreat mechanism. Hence, it is possible to collect sheets on the conveyance route onto the image forming route and to remove the sheets collectively. Moreover, it is possible to prevent the sheet from striking against the recording head and the like located in the image forming unit and thereby to prevent damages of the recording head.

Overlapped feed of sheets may be detected in the step of detecting a curl, and the image forming route may be retreated in the step of retreating and discharging when overlapped feed of sheets is detected in the step of detecting a curl.

According to the above-described configuration, overlapped feed of sheets is also detected in the step of detecting a curl. Hence it is possible to prevent the sheet from striking against the recording head and the like due to overlapped feed of sheets and thereby to prevent damages of the recording head.

The conveyance route may include: a common conveyance route continuing from a feeding route for feeding a sheet to a discharging route via the image forming unit; and a switchback route branched off and connected to the common conveyance route, the switchback route configured to reverse front and back surfaces of a sheet by receiving the sheet from the common conveyance route, reciprocating the sheet, and returning the sheet to the common conveyance route. And when the image forming route is retreated, a sheet existed inside the switchback route may be discharged onto the retreated image forming route in the step of retreating and discharging.

According to the above-described configuration, when a sheet trouble occurs in the printing machine having the switchback route, the sheets retaining inside the switchback route are conveyed to the image forming route in the step of retreating and discharging, whereby the sheets can be collected on the image forming route by using the retreat mechanism. Hence it is possible to easily remove the sheets that retain on the switchback route having the complicated mechanism.

DETAILED DESCRIPTION OF THE EMBODIMENTS

Hereinbelow, first and second embodiments of the present invention are described with reference to the drawings.

(First Embodiment)

(Overall Configuration of Printer)

Figure 1:
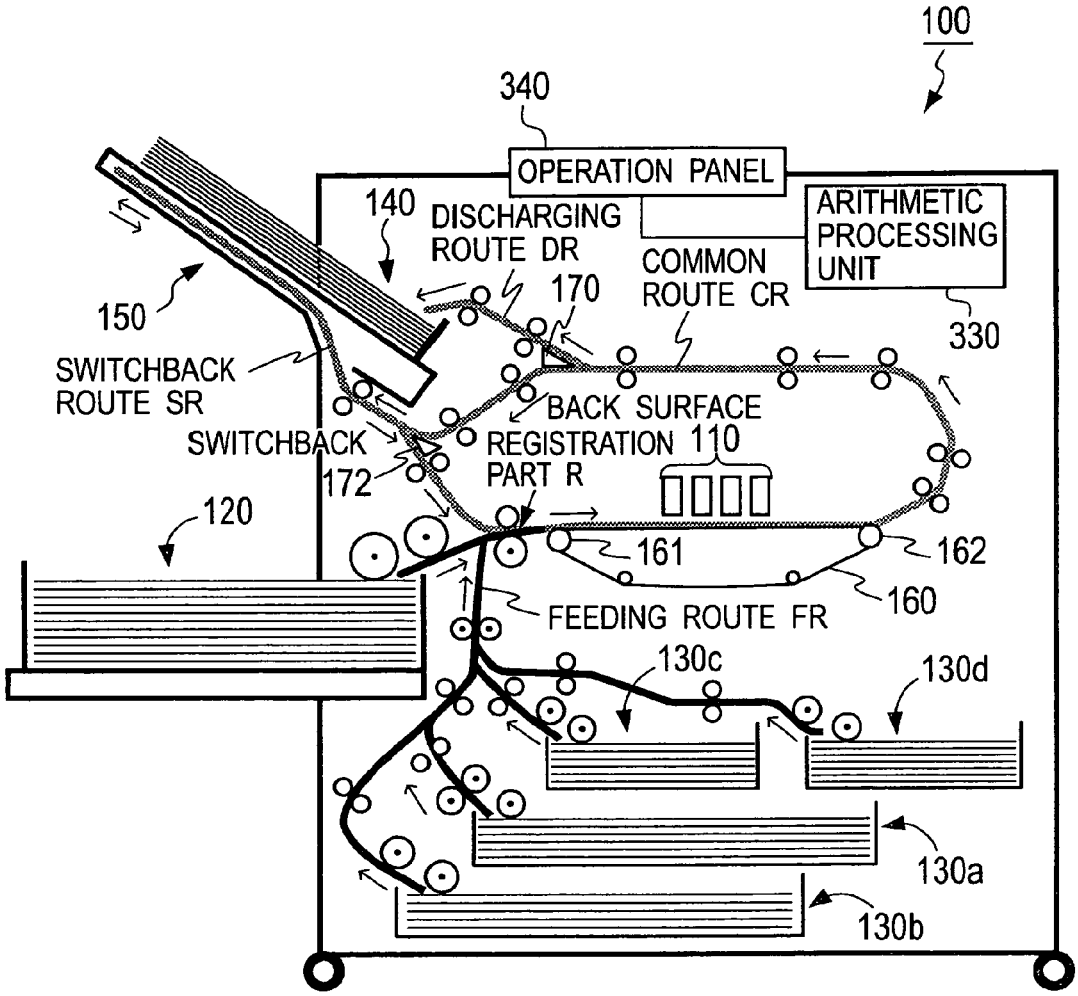
FIG. 1 is a configuration diagram showing an outline of a print sheet conveyance route of a printer according to a first embodiment and a second embodiment of the present invention.

FIG. 1 is a configuration diagram showing an outline of a print sheet conveyance route of a printer 100 according to a first embodiment of the present invention. In the first embodiment, the printer 100 is described by taking an inkjet line color printer as an example, which includes multiple ink heads each provided with numerous nozzles and is configured to perform printing on a line basis by ejecting black or color inks out of the ink heads respectively and to form multiple images on a recording sheet on a conveyance belt so that the images overlap each other.

As shown in FIG. 1, the printer 100 is an apparatus configured to form images on a surface of a sheet which is conveyed on an annular conveyance route. The conveyance route essentially includes a feeding route FR to feed sheets, a common route CR continuing from the feeding route FR to a sheet discharging route DR through a head unit 110, and a switchback route SR which is branched off and connected to the common route CR.

In the feeding route FR, paper feed mechanisms for supplying the print sheets include a side paper supply table 120 disposed outside a side face of a housing, and multiple paper feed trays 130*a*, 130*b*, 130*c*, and 130*d* disposed inside the housing. Meanwhile, a sheet discharge port 140 is provided as a sheet discharge mechanism for discharging the print sheets after being printed.

A print sheet fed from any of the paper feed mechanisms of the side paper supply table 120 and the paper feed trays 130*a*, 130*b*, 130*c*, and 130*d* is conveyed along the feeding route FR in the housing by means of a driving mechanism such as rollers, and is guided to a register R which is a reference position of a front edge of the print sheet. Beyond the registration part R along the conveyance direction, provided is the head unit 110 including multiple printing heads. The print sheet is conveyed by a platen belt 160 provided on an opposite side from the head unit at a speed determined in accordance with the printing condition and images are formed thereon on the line basis by the inks ejected from the respective printing heads.

The print sheet after being printed is further conveyed to the common route CR by the driving mechanism such as the rollers. In the case of one-side printing for printing only one side of the print sheet, the print sheet is directly lead to the sheet discharge port 140 through the sheet discharging route DR. Accordingly the print sheets are stacked on a paper receiving tray 150 provided as a receiving tray for the sheet discharge port 140 while having the printed surfaces facing downward. The paper receiving tray 150 is formed into a tray protruding from the housing and has a certain thickness. The paper receiving tray 150 is inclined and the print sheets discharged from the sheet discharge port 140 are naturally aligned and stacked by use of a wall formed in a lower position of the inclination.

On the other hand, in the case of both side printing for printing both sides of the print sheet, the print sheet is not guided to the sheet discharging route DR after printing a front surface (a surface to be printed in the first place will be hereinafter referred to as the "front surface" while the surface to be subsequently printed will be referred to as a "back surface"). Instead, the print sheet is further conveyed inside the housing and is sent out to the switchback route SR. Accordingly, the printer 100 is provided with a switching mechanism 170 for switching the route for back surface printing and the print sheet which is not sent out to the sheet discharging route DR is captured into the switchback route SR by means of the switching mechanism 170.

On the switchback route SR, so-called switchback is performed, in which the switchback route SR receives the sheet from the common route CR and the sheet has the front and back surfaces reversed by reciprocating the sheet. Then, the sheet is returned to the common route CR through the switching mechanism 172 by means of the driving mechanism such as the rollers and is fed again through the registration part R. Then, the back surface printing is executed in accordance with procedures similar to those for the front surface printing. Thereafter, the print sheet subjected to the back surface printing and provided with images on both surfaces is guided to the sheet discharge port 140 through the sheet discharging route DR, then discharged, and stacked on the paper receiving tray 150 provided as the receiving tray for the sheet discharge port 140.

In the first embodiment, the switchback operation at the time of both side printing is achieved by use of a space provided inside the paper receiving tray 150. The space provided inside the paper receiving tray 150 is covered so that the print sheet cannot be taken away from outside during the switchback operation. In this way, the first embodiment prevents a user from erroneously pulling out the print paper during the switchback operation. Moreover, the paper receiving tray 150 is an intrinsic component of the printer 100. Accordingly, performing the switchback operation by use of the space inside the paper receiving tray 150 eliminates the need for providing a space inside the printer 100 exclusive for the switchback. Therefore, the first embodiment prevents an increase in the size of the housing. In addition, since the discharging route DR and the switchback route SR are individually provided, the first embodiment allows the switchback operation and discharge of other sheets to be performed at the same time.

In the printer 100, the print sheet having one side printed is also fed again during the both side printing to the registration part R being the reference position of the front edge of the fed print sheet. For this reason, a junction for joining the conveyance route for the newly fed print sheet and a refeeding route for circulating and conveying the sheet having one side printed is formed immediately in front of the registration part R. Here, the registration part R sends out the sheets in the vicinity of the junction of the feeding route FR and the common route CR.

Figure 2:
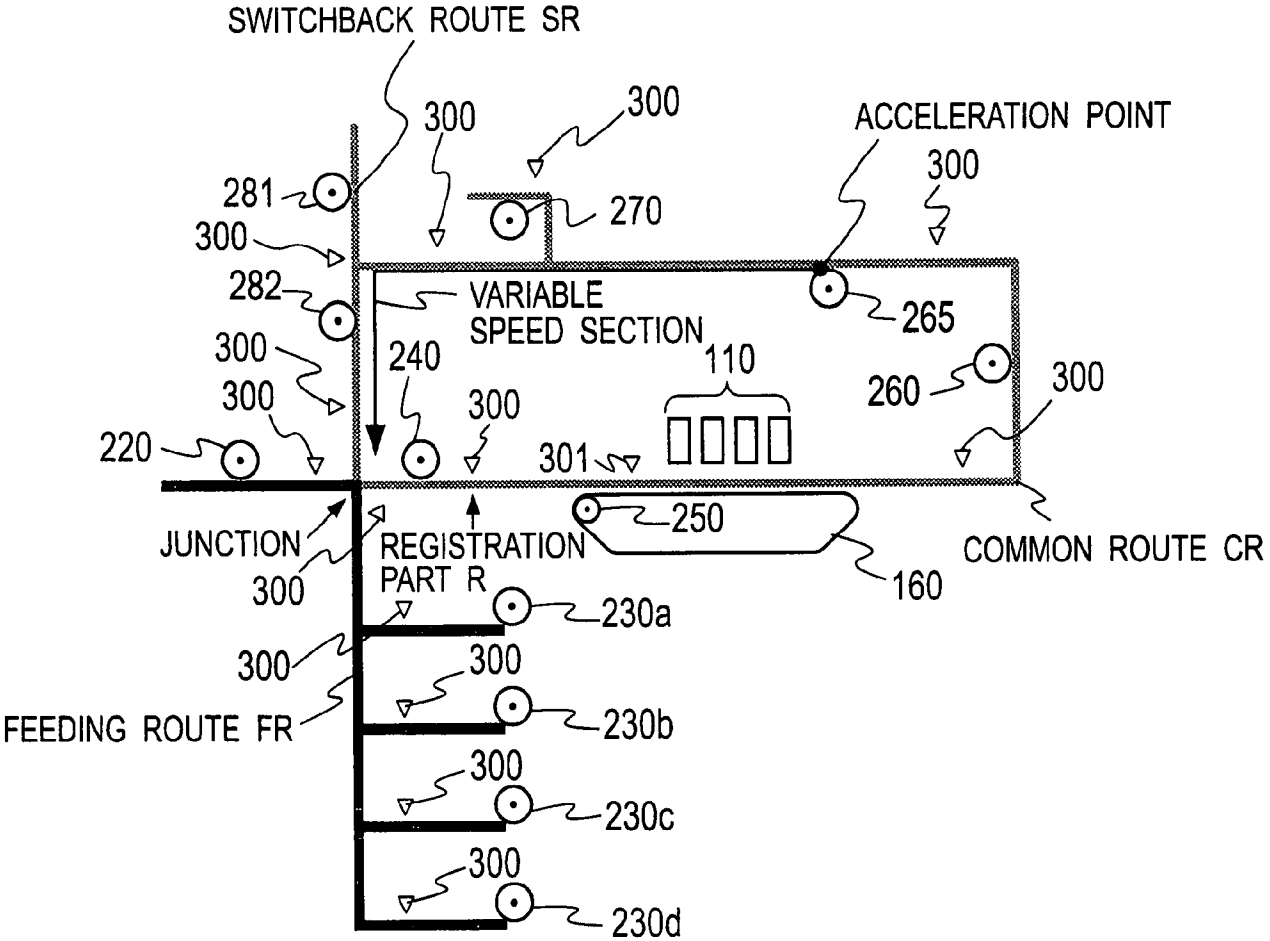
FIG. 2 is an explanatory view schematically showing a feeding route FR, a common route CR, and a switchback route SR according to the first and second embodiments of the present invention.

In the first embodiment, using the above-described junction as a reference, the route on the paper feed mechanism side is defined as the feeding route FR and the remaining route is defined as a conveyance route. As described previously, this conveyance route is formed into an annular shape and includes the common route CR and the switchback route SR. FIG. 2 is an explanatory view schematically showing the feeding route FR, the common route CR, and the switchback route SR. In this drawing, some rollers constituting drivers are omitted as appropriate.

The feeding route FR includes a side paper feed driver 220 for feeding paper from the side paper supply table 120, a tray 1 driver 230*a*, a tray 2 driver 230*b*, a tray 3 driver 230*c*, and a tray 4 driver 230*d* for feeding paper from the paper feed trays 130*a*, 130*b*, 130*c*, and 130*d*. These components constitute paper feeding means for sending the paper to the registration part R.

Each of the drivers (the tray 1 driver 230*a*, the tray 2 driver 230*b*, the tray 3 driver 230*c*, and the tray 4 driver 230*d*) in the above-described feeding route FR includes a driving mechanism formed by multiple rollers and is configured to capture the print sheets loaded on the paper supply table or the paper feed trays one by one and to convey the print sheets to the registration part R. The respective drivers can be driven independently and only the drivers corresponding to the paper feed mechanisms that feed the paper are operated as appropriate.

Multiple conveyance sensors 300 are disposed on the feeding route FR so as to detect a conveyance jam on the feeding route FR. Specifically, each conveyance sensor 300 is the sensor configured to detect presence of the print sheet or a front end of the print sheet. For example, the multiple conveyance sensors 300 are arranged at appropriate intervals on the conveyance route in a way that some of the conveyance sensors 300 are arranged on the paper feeding side and some of the conveyance sensors 300 are arranged on the conveyance side. Here, in a case where the conveyance-side conveyance sensors 300 do not detect a print sheet within a predetermined time period after the paper-feeding-side conveyance sensors 300 have detected the print sheet, the conveyance-side conveyance sensors 300 can determine that a conveyance jam has occurred.

Among these conveyance sensors 300, a register sensor in front of the registration part R configured to send out the sheets measures the size of the sheet in conveyance. For example, a determination can be made, based on the traveling speed and traveling time of the sheet, that the conveyance jam (a paper feed error) has occurred on a fact that the conveyance sensor 300 does not detect the print sheet within a predetermined time period after measuring the size of the sheet being passed through or after driving the side paper feed driver 220, the tray 1 driver 230*a* or the like.

The common route CR constitutes part of the circulating conveyance route, which is the route continuing from the feeding route FR for feeding the sheets to the sheet discharging route DR through the head unit 110. Images are formed on an upper surface of the sheet in the course of the common route CR. The common route CR includes a register driver 240 configured to guide the print sheet to the registration part R, a belt driver 250 configured to drive a platen belt 160 provided on the opposite side from the head unit 110 so as to move the platen belt 160 endlessly, a first upper surface conveyance driver 260 and a second upper surface conveyance driver 265 sequentially arranged in the conveyance direction, an upper surface discharge driver 270 configured to guide the printed sheet to the sheet discharge port 140, and a driver configured to drag the print sheet into the switchback route SR for the purpose of back surface printing. Each of the drivers includes a driving mechanism provided with one or multiple rollers and the like and is configured to convey the print sheets one by one along the conveyance route. The drivers can be driven independently and only the drivers needed corresponding to the conveyance state of the print sheets are operated.

Moreover, multiple conveyance sensors 300 are disposed also on the common route CR so as to detect a conveyance jam on the common route CR. Furthermore, the registration part R is also configured to check whether or not the print sheet is conveyed properly. On the common route CR, the conveyance sensors 300 are located so as to correspond to the drivers. Accordingly, it is possible to specify which driver on the common route CR is involved in occurrence of the conveyance jam.

The switchback route SR is branched off and connected to the common route CR and constitutes the switchback route and a conveyance mechanism configured to reverse the front and back surfaces of the sheet by receiving the sheet from the common route CR and reciprocating (subjecting to switchback) to return the sheet to the common route CR. The switchback route SR includes a switchback driver 281 configured to reverse the front and back surfaces of the sheet and to guide the sheet to the junction. Moreover, the switchback route SR can convey the sheet at a different speed from the common route CR does. When receiving the sheet from the common route CR, the switchback route SR is able to accelerate or decelerate the sheet or to extend or reduce stop time for the switchback.

Moreover, in the first embodiment, after a print sheet is fed, a subsequent print sheet does not have to wait to be fed until the precedent print sheet is subjected to printing and discharged, but can be feed, before the precedent print sheet is discharged, and can be printed continuously at a predetermined interval by means of scheduling. Therefore, in the course of normal scheduling for both side printing, a certain space is reserved in advance, when a sheet for printing on a front surface is fed, for another sheet returning from the switchback route SR to be inserted. In this way, this apparatus can perform the front surface printing and the back surface printing at the same time, so that the productivity for the both side printing is ensured to be half of that for the one-side printing.

The platen belt 160 is wound around a driving roller 161 and a driven roller 162 which are located in positions not including a front end and a front end (a tail end in FIG. 1) of the surface opposed to the head unit 110 and is rotated clockwise in FIG. 1. Meanwhile, four ink heads of yellow (Y), magenta (M), cyan (C), and black (B) are arranged above the platen belt 160 along the traveling direction of the belt, and the head unit 110 configured to form color images in a way that multiple images overlap each other is disposed opposite from the platen belt 160.

As shown in FIG. 1, the printer 100 includes an arithmetic processing unit 330. The arithmetic processing unit 330 is a processing module provided with hardware including a processor such as a CPU or a DSP (digital signal processor), a memory, an electric circuit, and the like, software such as programs having functions as the aforementioned hardware, or a combination thereof. The arithmetic processing unit 330 virtually constructs various function modules by reading and executing programs as appropriate and executes various processes including processes related to image data, operation control of the constituents, response to user operations, and the like by use of the function modules thus constructed. An operation panel 340 is connected to the arithmetic processing unit 330 so as to receive instructions and setting operations by the user via the operation panel 340.

(Transfer Control Mechanism)

Figure 3A:
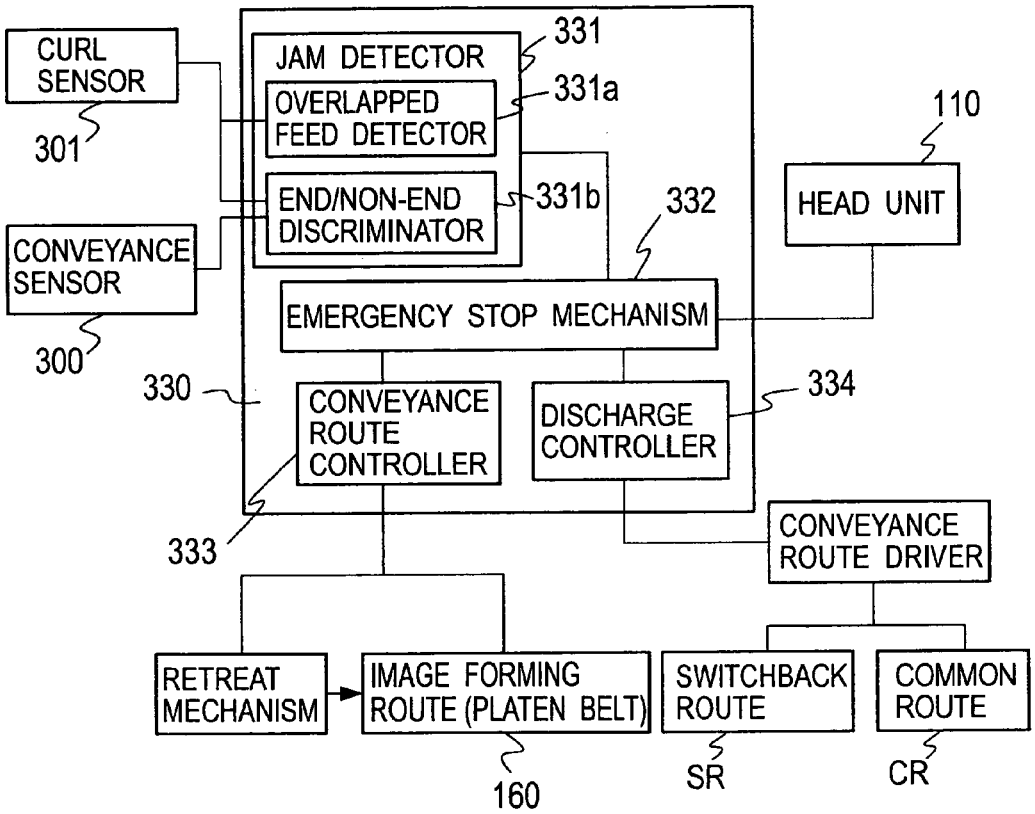
FIG. 3A is a block diagram showing a module related to a sheet conveyance mechanism according to the first embodiment of the present invention and FIG. 3B and FIG. 3C are explanatory views showing a configuration and operations of a curl sensor.
Figure 3B:
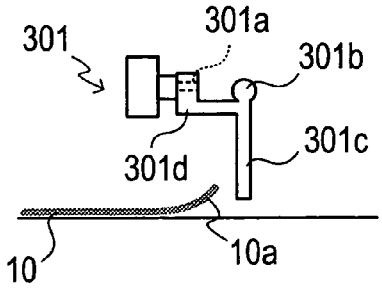
Figure 3C:
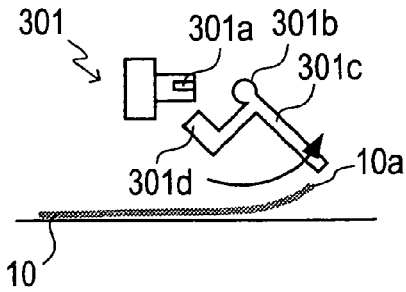

In the first embodiment, control of the sheet conveyance mechanism is executed by the arithmetic processing unit 330. FIG. 3A is a block diagram showing a module of the sheet conveyance mechanism according to the first embodiment, while FIG. 3B and FIG. 3C are explanatory views showing a configuration and operations of a curl sensor. As shown in FIG. 3A, the module of the sheet conveyance mechanism includes a jam detector 331, an emergency stop mechanism 332, a conveyance route controller 333, and a discharge controller 334.

The jam detector 331 is the module configured to detect occurrence of a trouble on the conveyance route based on detection results from a curl sensor 301 located upstream of the head unit 110 and other conveyance sensors 300. In the first embodiment, the jam detector 331 further includes a overlapped feed detector 331*a* configured to detect overlapped feed of the print sheets and an end/non-end discriminator 331*b* configured to detect a curl of an end of the sheet.

The overlapped feed detector 331*a* and the end/non-end discriminator 331*b* are the modules configured to detect a curl of the sheet particularly in the route from the registration part R to the head unit 110 out of jamming troubles in the course of the conveyance route and to detect so-called overlapped feed in which multiple sheets are conveyed while overlapping each other.

The curl sensor 301 is a contact sensor configured to detect the curl of the sheet on the upstream of the head unit 110 on the conveyance route. In the first embodiment, the curl sensor 301 has a configuration in that a contact portion 301*c* having an L-shaped cross section is rotatably supported by a shaft 301*b* as shown in FIG. 3B and FIG. 3C. When a curled portion (a front end, for example) 10*a* of a sheet 10 strikes against the contact portion 301*c* of the curl sensor 301, the contact portion 301*c* is lifted up by the curled portion 10*a* so that a light-shielding portion 301*d* is rotated together with the contact portion 301*c*. This rotation removes the light shield of the light-shielding portion 301*d* whereby an optical sensor 301*a* reacts to detect the curl of the sheet. In the first embodiment, the contact sensor is employed as the curl sensor. However, it is also possible to employ a reflective sensor, a transmissive sensor, or various other sensors as long as such the sensor can detect a change in the shape or the thickness of the sheet.

Moreover, when the curl sensor 301 detects the curl of the sheet, the overlapped feed detector 331*a* and the end/non-end discriminator 331*b* analyze detection signals outputted from other conveyance sensors 300 located in front of and behind the curl sensor 301 and detects whether or not the curl occurs at the front end of the sheet or a position other than the front end. The curl sensor 301, the overlapped feed detector 331*a* and the end/non-end discriminator 331*b* are included in a curl detector.

The conveyance route controller 333 is the module configured to control drive and stop of the driving mechanisms for driving a retreat mechanism, the platen belt 160, and the conveyance routes including the switchback route SR and the common route CR. The discharge controller 334 is the module configured to control the driving mechanism for sheet discharge. Moreover, the conveyance route controller 333 and the discharge controller 334 also control a so-called recovery operation to discharge the sheets retaining on the conveyance route after an emergency stop.

The emergency stop mechanism 332 controls timing, an operating speed, and an operating direction to stop the conveyance and the printing process upon an emergency stop and also controls the conveyance route supposed to be continuously operated so that the conveyance route continues operation without an emergency stop.

Moreover, in the first embodiment, when a trouble (jam) such as a curl or overlapped feed is detected on the conveyance route, the emergency stop mechanism 332, the conveyance route controller 333, and the discharge controller 334 control the platen belt 160 so that the platen belt 160 is retreated by use of the retreat mechanism and the sheet located on the common route CR or an outbound line of the switchback route SR is controlled by temporarily stopping the conveyance rollers, discharging the sheet, and so forth.

Figure 5A:
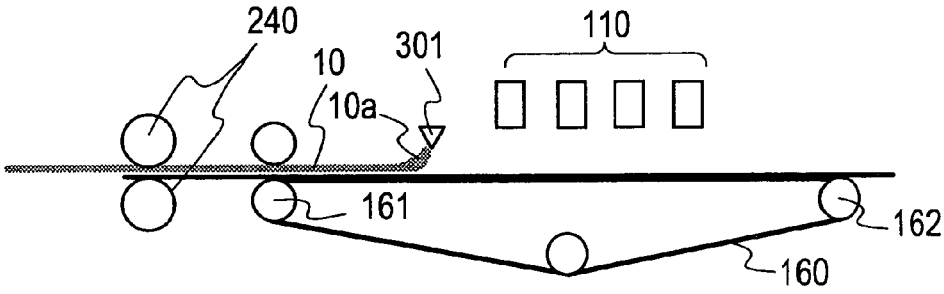
FIGS. 5A to 5C are explanatory views schematically showing detection of a curled sheet and the operations of the conveyance mechanism according to the first embodiment of the present invention.
Figure 5B:
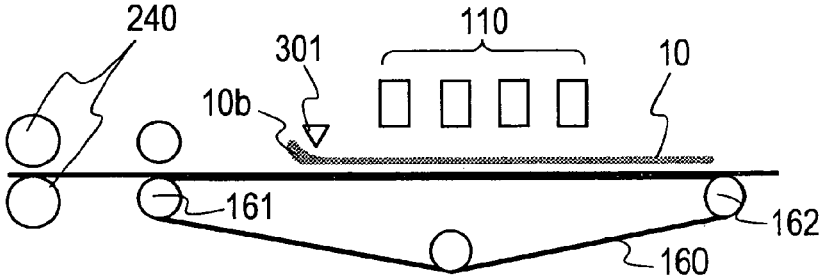
Figure 5C:
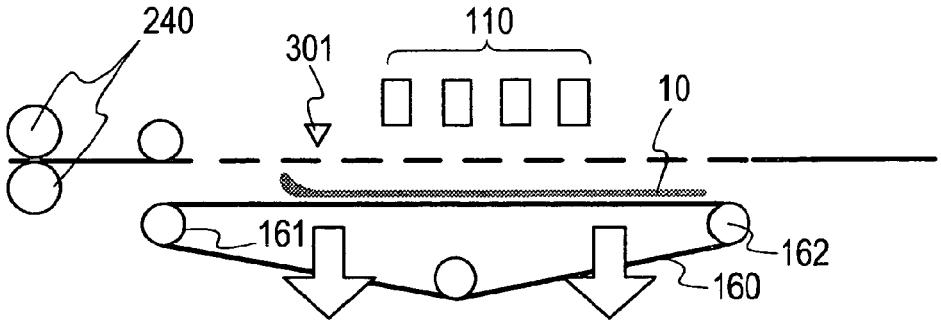

In particular, the conveyance routes are driven or stopped differently depending on whether the curl sensor 301 detects the curled portion 10*a* at the front end of the sheet as shown in FIG. 5A or at a position other than the front end (tail end in FIG. 5B) of the sheet as shown in FIG. 5B. To be more precise, when the curl sensor 301 detects the curl at the front end of the sheet, the conveyance route controller 333 brings the paper feed mechanism that feeds the sheets to the conveyance route to an emergency stop and continues conveying the sheets which are already in conveyance on the conveyance route. On the other hand, when the curl sensor 301 detects the curl at a position other than the front end of the sheet, the conveyance route controller 333 stops the conveyance drive of the platen belt 160 and retreats the platen belt 160 in a direction of an arrow as shown in FIG. 5C, for example, by use of the retreat mechanism.

Here, as the above-described retreat mechanism, the platen belt 160 is a device to collectively lower the rollers 161 and 162 for rotating the platen belt 160 and the drivers for these components. As the device for lowering the components, conceivable is a mechanism to move the components downward by way of an elastic force generated by biasing means such as an actuator, a motor or a spring, for example. Although the first embodiment shows the example of lowering the platen belt 160, it is alternatively possible to retreat the platen belt 160 in any directions as long as retreating the platen belt 160 in the direction prevents the sheet on the platen belt 160 from striking against the head unit 110.

(Transfer Control Method)

Figure 4A:
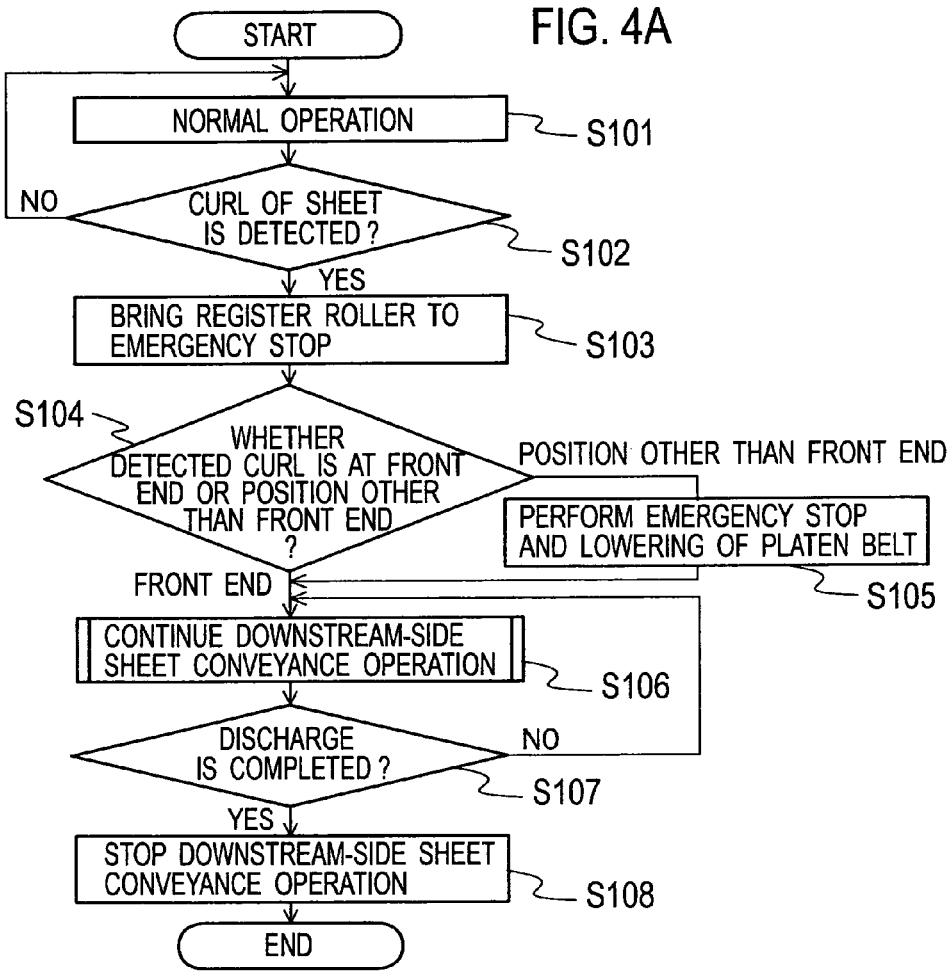
FIGS. 4A and 4B are flowcharts showing operations of the sheet conveyance mechanism according to the first embodiment of the present invention.

A conveyance control method according to the first embodiment can be embodied by use of the above-described conveyance control mechanism. FIG. 4A is a flowchart showing operations of the sheet conveyance mechanism according to the first embodiment and FIGS. 5A to 5C are explanatory views schematically showing the operations of the sheet conveyance mechanism.

As shown in FIG. 4A, while the sheets are conveyed on the conveyance route and printed in accordance with a normal operation (S101), any curl on the sheets is monitored on the upstream of the head unit 110 (S102). The normal operation is continued (S101) as long as no curls of the sheets are detected ("N" in Step S102.)

When a curl of the sheet is detected on the upstream of the head unit 110 in Step S102 ("Y" in S102,) register rollers of the registration part R is immediately brought to an emergency stop under control of the emergency stop mechanism 332 (S103). After the emergency stop of the register rollers, it is determined whether the detected curl is located at the front end of the sheet or a position other than the front end thereof (S104).

When the curl at a position other than the front end of the sheet is detected in Step S104 ("other than the front end" in S104), an image forming route unit (the platen belt 160, the driving roller 161, the driven roller 162, and so forth) is brought to an emergency stop by the retreat mechanism and the image forming route unit is lowered (S105) by use of the retreat mechanism. Then the image forming route unit is retreated so as to be separated from the common conveyance route as shown in FIG. 5C. Thereafter, the sheets located downstream of the platen belt 160 are conveyed to the common conveyance route and are discharged from the sheet discharging route DR.

On the other hand, if the curl of the sheet is detected at the front end in Step S104, the sheets located downstream of the platen belt 160 are discharged from the sheet discharging route DR while keeping the register roller stopped without carrying out Step S105.

Thereafter, the sheets which have been already in conveyance on the conveyance route are continuously subjected to a downstream-side sheet conveyance operation (S106) until completion of the sheet discharge (S107) (during "N" in S107). After all the sheets are discharged ("Y" in S107), the downstream-side sheet conveyance operation is stopped (S108) to terminate the sheet conveyance.

Figure 4B:
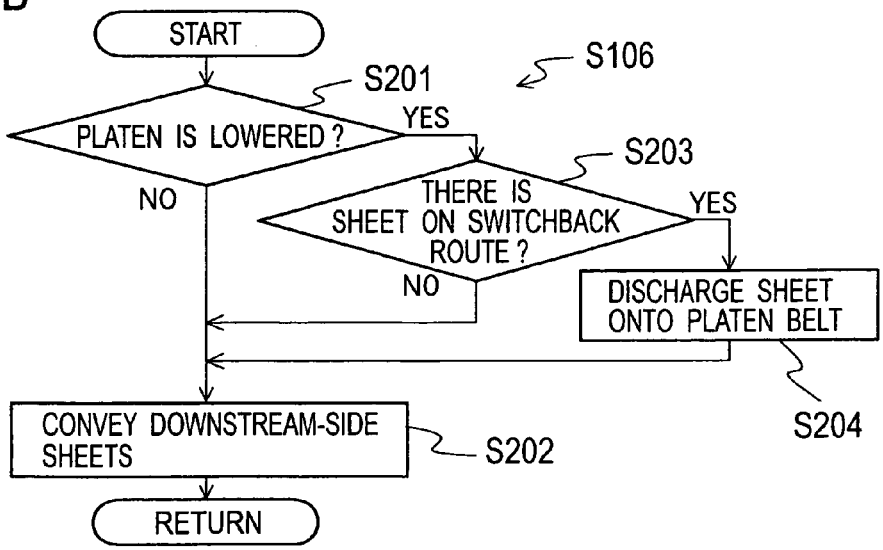

In the first embodiment, the discharge controller 334 performs such a control, in the sheet conveyance operation in the above-described Step S106, that the platen belt 160 which is lowered is used as the paper receiving tray. FIG. 4B is a flowchart showing an operation of the sheet conveyance mechanism according to the first embodiment and FIG. 6 is an explanatory view schematically showing the operation of the sheet conveyance mechanism.

Figure 6:
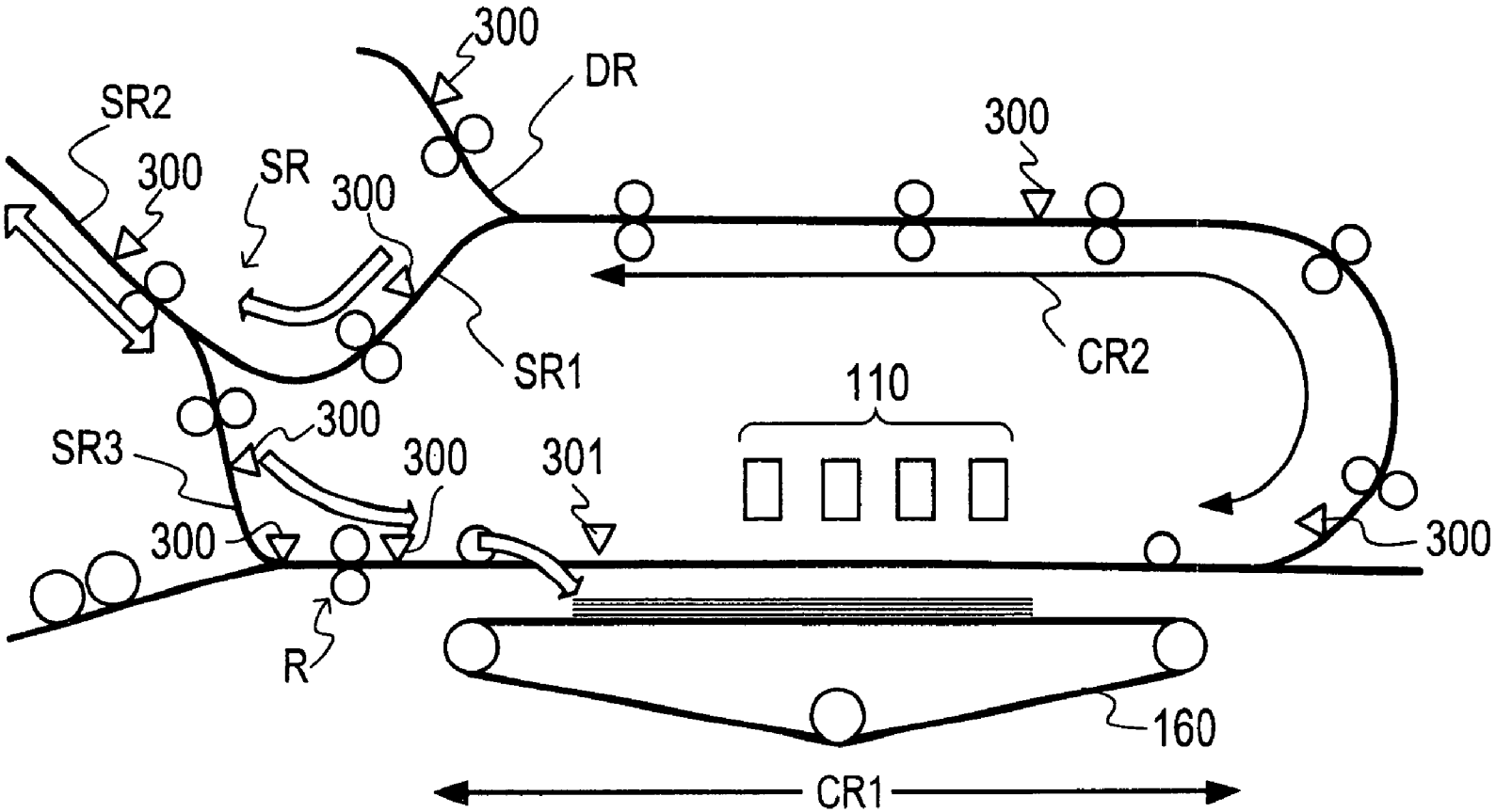
FIG. 6 is an explanatory view schematically showing the operations of the sheet conveyance mechanism according to the first embodiment of the present invention.

As shown in FIG. 6, the common route CR for the sheets includes an image forming route CR1 formed of the platen belt 160 and the like, and a downstream-side conveyance route CR2 configured to convey the sheets to the sheet discharging route DR after image formation. The retreat mechanism separates and retreats the image forming route CR1 from the conveyance route. When the platen belt 160 is retreated by the retreat mechanism, the conveyance route controller 333 and the discharge controller 334 discharge the sheets in the switchback route SR into the retreated platen belt 160.

In the first embodiment, the sheet discharge to this image forming route CR1 is achieved by discharging the sheets in conveyance on the conveyance route onto the retreated image forming route CR1 as shown in FIG. 6 when the platen belt brought to an emergency stop and lowered (S105).

To be more precise, in Step S106 of FIG. 4A, when the sheet conveyance operation is continued on the downstream side as shown in FIG. 4B, whether or not the platen is lowered is determined (S201), and if yes, the presence of the sheet on the switchback route SR is checked (S203). When the platen belt is lowered and the sheet is present on the switchback route SR ("Y" in S201 and "Y" in S203), the sheet remaining inside the switchback route SR is discharged onto the platen belt 160 which is lowered and the sheet located downstream of the platen belt 160 are discharged (S202). In other cases, the recovery inside the switchback route SR is not carried out and only the discharge of the sheets on the downstream is executed (S202).

(Operations and Effects)

According to the first embodiment as described above, when a curl of a sheet is detected, the operations after the emergency stop of the register roller is changed depending on whether the curl occurs at the front end of the sheet or at a position other than the front end. In this way, it is possible to prevent the head unit 110 and the curled portion of the sheet to come into contact with each other and thereby to protect the head unit 110. Moreover, it is possible to deal with various circumstances. For example, the printed sheets are discharged to a usual discharging route DR through a downstream-side conveyance route CR2 to prevent printed sheets from being wasted, or as to unprinted sheets, a printing process is brought to an emergency stop or the unprinted sheets are retreated into another route or the like to preferentially protect the recording head.

To be more precise, in the first embodiment, when the curl is detected at the front end of the sheet, it is possible to preferentially prevent the unprinted sheets from damaging the recording head of the image forming unit (head unit 110) by means of an emergency stop of the paper feed mechanism. Meanwhile, printed sheets, which are currently being printed, located on an image forming route CR1 and printed sheets, which have been already printed, located on the downstream-side conveyance route CR2 can be discharged via the common route CR as usual. Hence it is possible to prevent the sheets from being wasted.

On the other hand, when the curl is detected at a position other than the front end of the sheet, the printing process is in progress on the sheet on the image forming route CR1 of which the curl is detected. Therefore, the sheet printed only partly is separated from the head unit 110 together with the image forming route CR1 by using the retreat mechanism to prevent the sheet from coming into contact with and damaging the head unit 110.

Moreover, in the first embodiment, if the curl detector detects the curl of the sheet, the sheet in the switchback route SR is discharged onto the retreated image forming route CR1 when the image forming route CR1 is retreated by the retreat mechanism. Accordingly, when there is a sheet trouble on the switchback route SR, the sheet that retains on the switchback route SR is conveyed to the platen belt 160 which is lowered in order to discharge the sheet. Hence it is possible to easily remove the sheet that retains in the switchback route SR having the complicated mechanism.

As described above, the first embodiment can prevent the sheet from striking against the recording head of the image forming unit by detecting whether the curl of the sheet is located at the front end or at a position other than the front end. Moreover, the first embodiment can facilitate an operation to remove a jammed recording medium to be executed by a user if a recording medium is jammed somewhere on the conveyance route.

(Second Embodiment)

Next, a second embodiment of the present invention will be described with reference to the accompanying drawings. The "overall configuration of the printer" of the second embodiment is the same as that of the first embodiment so that the redundant explanation is omitted herein. Moreover, constituents having similar functions to those in the first embodiment will be denoted by similar reference numerals in the following description.

(Transfer Control Mechanism)

Figure 7:
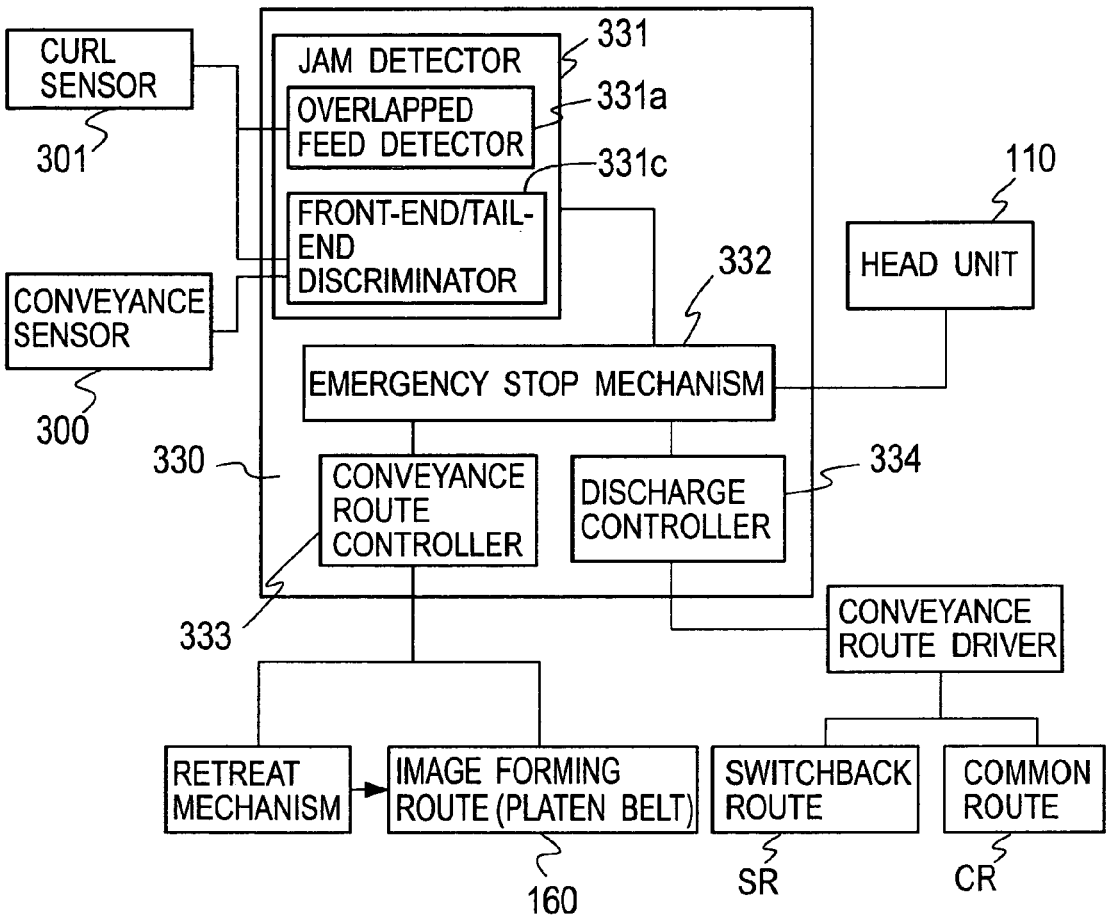
FIG. 7 is a block diagram showing a module related to a sheet conveyance mechanism according to the second embodiment of the present invention.

In the second embodiment, control of the sheet conveyance mechanism is executed by the arithmetic processing unit 330. FIG. 7 is a block diagram showing a module of the sheet conveyance mechanism according to the second embodiment. As shown in FIG. 7, the module of the sheet conveyance mechanism includes a jam detector 331, an emergency stop mechanism 332, a conveyance route controller 333, and a discharge controller 334.

The jam detector 331 is the module configured to detect occurrence of a trouble on the conveyance route based on detection results from a curl sensor 301 located upstream of the head unit 110 and other conveyance sensors 300. In the second embodiment, the jam detector 331 further includes a overlapped feed detector 331*a* configured to detect overlapped feed of the print sheets and a front-end/tail-end discriminator 331*c* configured to detect a curl of an end of the sheet. The curl sensor 301, the overlapped feed detector 331*a* and the front-end/tail-end discriminator 331*c* are included in a curl detector.

The overlapped feed detector 331*a* and the front-end/tail-end discriminator 331*c* are the modules configured to detect a curl of the sheet particularly in the route from the registration part R to the head unit 110 out of jamming troubles in the course of the conveyance route and to detect so-called paper stack feeding in which multiple sheets are conveyed while overlapping each other. The curl sensor 301 detects a curl of a sheet on the upstream of the head unit 110 on the conveyance route. When this curl sensor 301 detects the curl of the sheet, the overlapped feed detector 331*a* and the front-end/tail-end discriminator 331*c* analyze detection signals outputted from other conveyance sensors 300 located in front of and behind this curl sensor 301 and detects whether the curl is located at a front end or a tail end of the sheet.

The conveyance route controller 333 is the module configured to control drive and stop of the driving mechanisms for driving a retreat mechanism, the platen belt 160, and the conveyance routes including the switchback route SR and the common route CR. The discharge controller 334 is the module configured to control the driving mechanism for sheet discharge. Moreover, the conveyance route controller 333 and the discharge controller 334 also control a so-called recovery operation to discharge the sheets retaining on the conveyance route after an emergency stop.

The emergency stop mechanism 332 controls timing, an operating speed, and an operating direction to stop the conveyance and the printing process upon an emergency stop and also controls the conveyance route supposed to be continuously operated so that the conveyance route continues operation without an emergency stop.

Moreover, in the second embodiment, when a trouble (jam) such as a curl or overlapped feed is detected on the conveyance route, the emergency stop mechanism 332, the conveyance route controller 333, and the discharge controller 334 control the platen belt 160 so that the platen belt 160 is retreated by use of the retreat mechanism and the sheet located on the common route CR or an outbound line of the switchback route SR is controlled by temporarily stopping the conveyance rollers, discharging the sheet, and so forth.

Figure 9A:
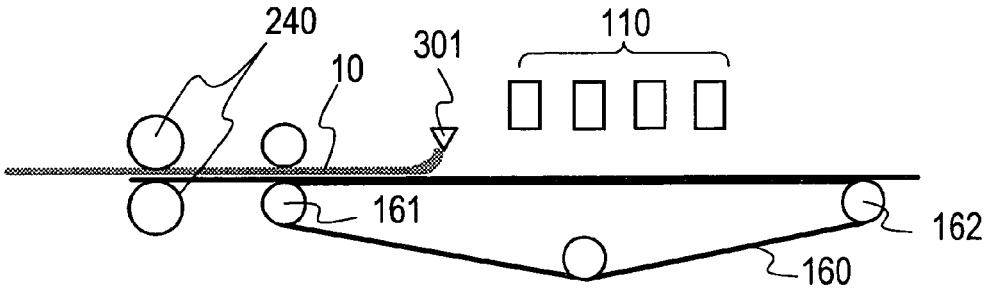
FIGS. 9A to 9C are explanatory views schematically showing detection of a curled sheet and the operations of the conveyance mechanism according to the second embodiment of the present invention.
Figure 9B:
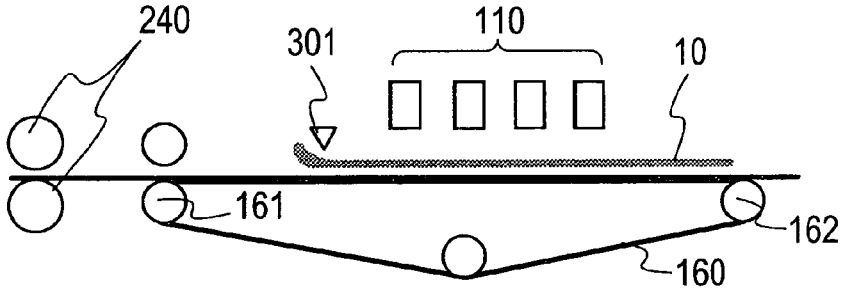
Figure 9C:
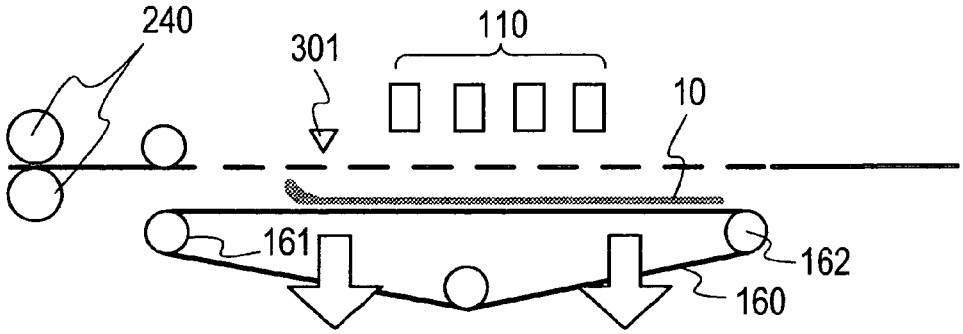

In particular, the conveyance routes are driven or stopped differently depending on whether the curl sensor 301 detects a curl at the front end of the sheet as shown in FIG. 9A or at the tail end of the sheet as shown in FIG. 9B. To be more precise, when the curl sensor 301 detects the curl at the front end of the sheet, the conveyance route controller 333 brings the paper feed mechanism that feeds the sheets to the conveyance route to an emergency stop and continues conveying the sheets which are already in conveyance on the conveyance route. On the other hand, when the curl sensor 301 detects the curl at the tail end of the sheet, the conveyance route controller 333 stops the conveyance drive of the platen belt 160 and retreats the platen belt 160 as shown in FIG. 9C by use of the retreat mechanism.

Here, as the above-described retreat mechanism, the platen belt 160 is a device to collectively lower the rollers 161 and 162 for rotating the platen belt 160 and the drivers for these components. As the device for lowering the components, conceivable is a mechanism to move the components downward by way of an elastic force generated by biasing means such as an actuator, a motor or a spring, for example. Although the second embodiment shows the example of lowering the platen belt 160, it is alternatively possible to retreat the platen belt 160 in any directions as long as retreating the platen belt 160 in the direction prevents the sheet on the platen belt 160 from striking against the head unit 110.

(Transfer Control Method)

Figure 8A:
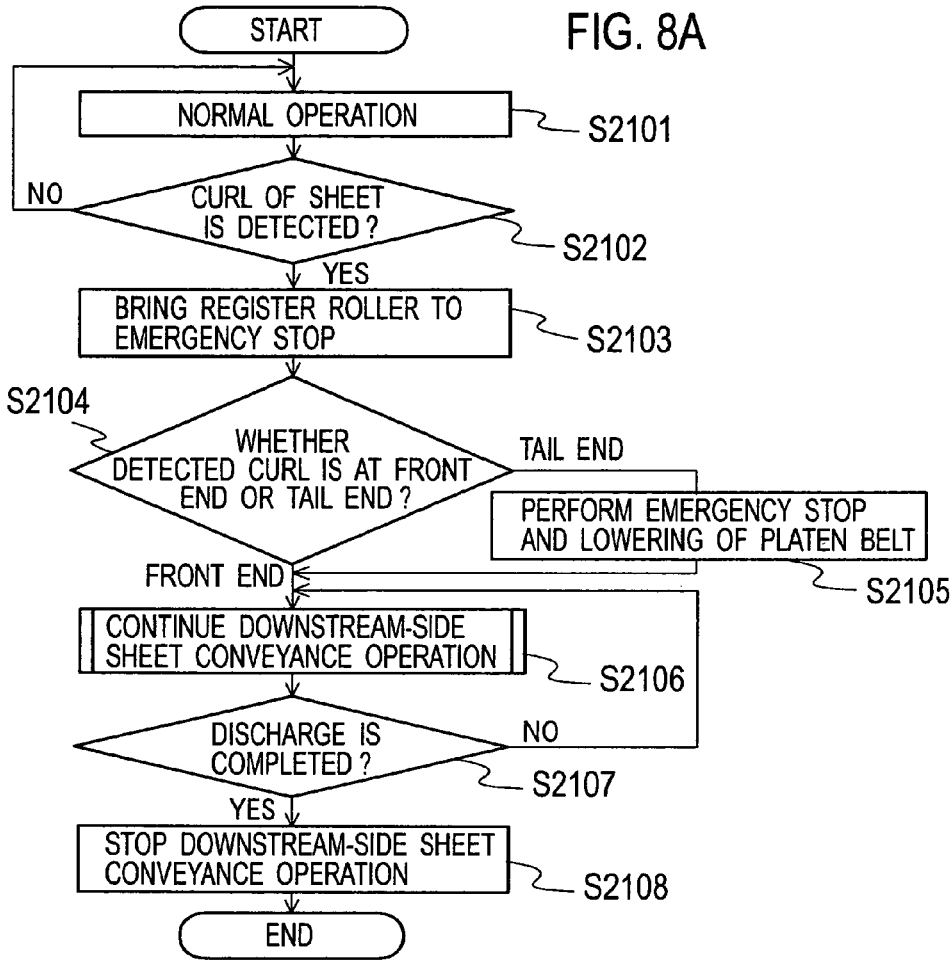
FIGS. 8A and 8B are flowcharts showing operations of the sheet conveyance mechanism according to the second embodiment of the present invention.

A conveyance control method according to the second embodiment can be embodied by use of the above-described conveyance control mechanism. FIG. 8A is a flowchart showing operations of the sheet conveyance mechanism according to the second embodiment and FIGS. 9A to 9C are explanatory views schematically showing the operations of the sheet conveyance mechanism.

As shown in FIG. 8A, while the sheets are conveyed on the conveyance route and printed in accordance with a normal operation (S2101), any curl on the sheets is monitored on the upstream of the head unit 110 (S2102). The normal operation is continued (S2101) as long as no curls of the sheets are detected ("N" in Step S2102.)

When a curl of the sheet is detected on the upstream of the head unit 110 in Step S2102 ("Y" in S2102,) register rollers of the registration part R is immediately brought to an emergency stop under control of the emergency stop mechanism 332 (S2103). After the emergency stop of the register rollers, it is determined whether the detected curl is located at the front end of the sheet or the tail end thereof (S2104).

When the curl at the tail end of the sheet is detected in Step S2104 ("the tial end" in S2104), an image forming route unit (the platen belt 160, the driving roller 161, the driven roller 162, and so forth) is brought to an emergency stop by the retreat mechanism and the image forming route unit is lowered (S2105) by use of the retreat mechanism. Then the image forming route unit is retreated so as to be separated from the common conveyance route as shown in FIG. 9C. Thereafter, the sheets located downstream of the platen belt 160 are conveyed to the common conveyance route and are discharged from the sheet discharging route DR.

On the other hand, if the curl of the sheet is detected at the front end in Step S2104, the sheets located downstream of the platen belt 160 are discharged from the sheet discharging route DR while keeping the register roller stopped without carrying out Step S2105.

Thereafter, the sheets which have been already in conveyance on the conveyance route are continuously subjected to a downstream-side sheet conveyance operation (S2106) until completion of the sheet discharge (S2107) (during "N" in S2107). After all the sheets are discharged ("Y" in S2107), the downstream-side sheet conveyance operation is stopped (S2108) to terminate the sheet conveyance.

Figure 8B:
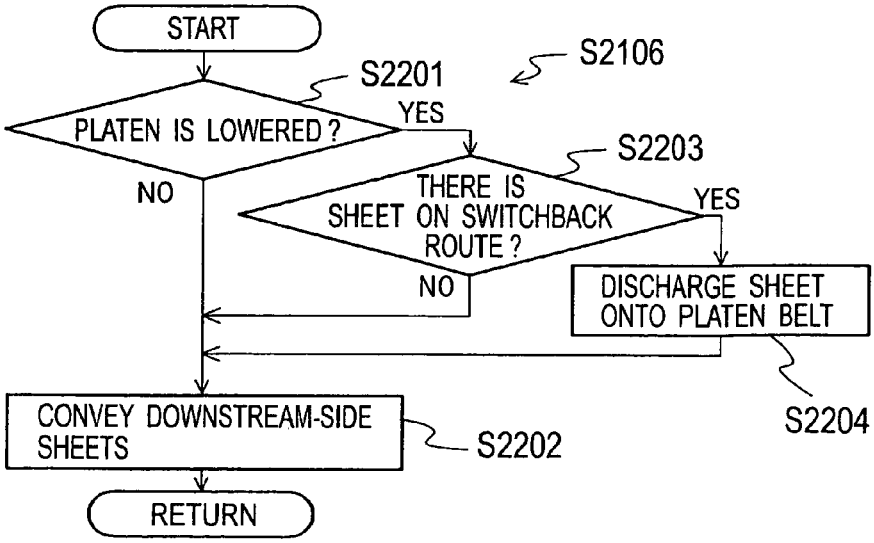

In the second embodiment, the discharge controller 334 performs such a control, in the sheet conveyance operation in the above-described Step S2106, that the platen belt 160 which is lowered is used as the paper receiving tray. FIG. 8B is a flowchart showing an operation of the sheet conveyance mechanism according to the second embodiment and FIG. 10 is an explanatory view schematically showing the operation of the sheet conveyance mechanism.

Figure 10:
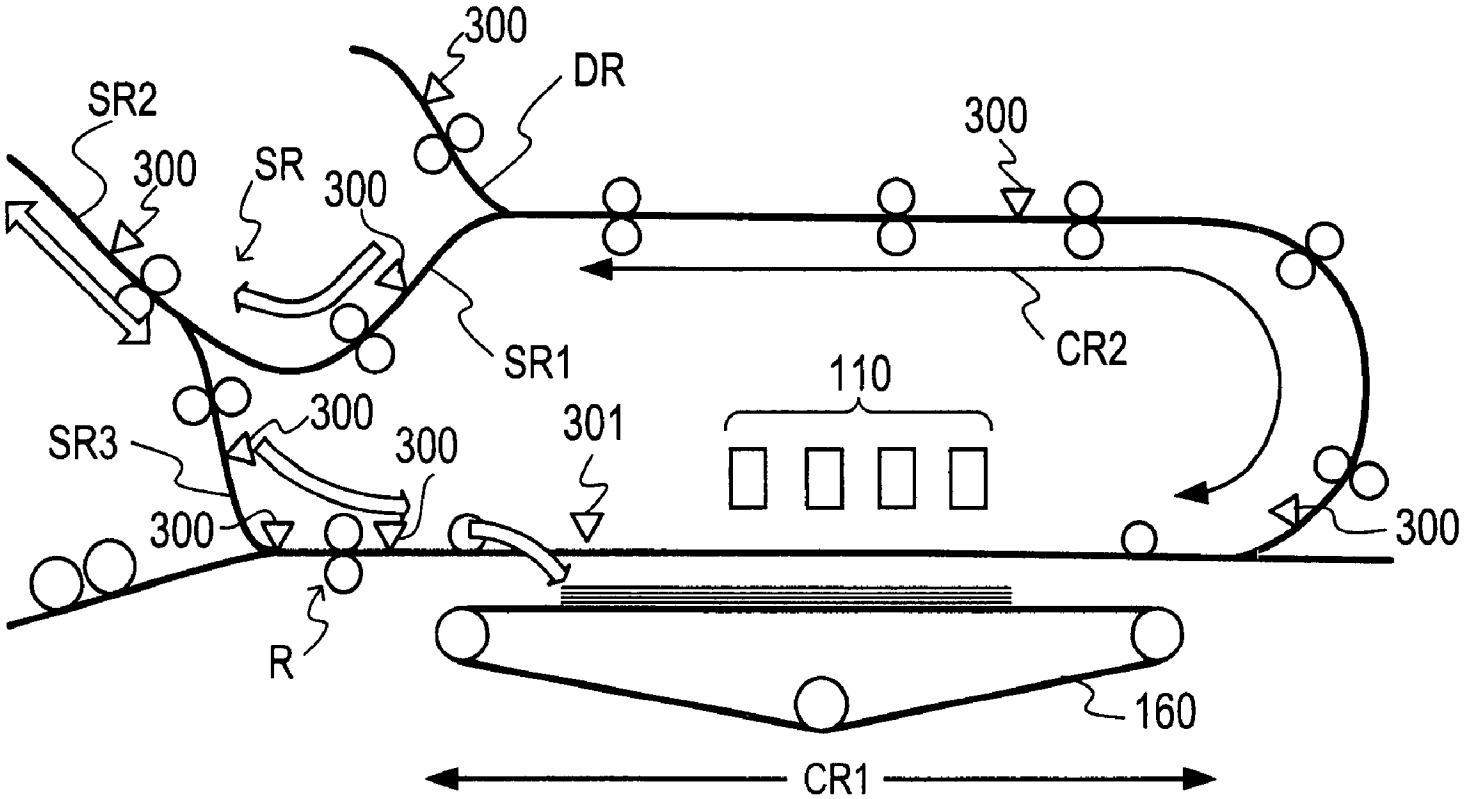
FIG. 10 is an explanatory view schematically showing the operations of the sheet conveyance mechanism according to the second embodiment of the present invention.

As shown in FIG. 10, the common route CR for the sheets includes an image forming route CR1 formed of the platen belt 160 and the like, and a downstream-side conveyance route CR2 configured to convey the sheets to the sheet discharging route DR after image formation. The retreat mechanism separates and retreats the image forming route CR1 from the conveyance route. When the platen belt 160 is retreated by the retreat mechanism, the conveyance route controller 333 and the discharge controller 334 discharge the sheets in the switchback route SR onto the retreated platen belt 160.

To be more precise, in the second embodiment, the sheet discharge to the image forming route CR1 is carried out by driving the register roller at a low speed when the platen belt is brought to an emergency stop and lowered (S2105) as shown in FIGS. 8A and 8B. Then, the sheets being in conveyance on the conveyance route are discharged onto the retreated image forming route CR1 as shown in FIG. 10.

To be more precise, in Step S2106 of FIG. 8A, when the sheet conveyance operation is continued on the downstream side as shown in FIG. 8B, whether or not the platen is lowered is determined (S2201), and if yes, the presence of the sheet on the switchback route SR is checked (S2203). When the platen belt is lowered and the sheet is present on the switchback route SR ("Y" in S2201 and "Y" in S2203), the sheet remaining inside the switchback route SR is discharged onto the platen belt 160 which is lowered and the sheet located downstream of the platen belt 160 are discharged (S2202). In other cases, the recovery inside the switchback route SR is not carried out and only the discharge of the sheets on the downstream is executed (S2202).

The second embodiment has described by taking as an example a case where the sheet remains in the switchback route SR. Here, it is possible to discharge not only the sheet remaining on the switchback route but also the sheets remaining on other routes (such as the downstream-side conveyance route CR2) onto the platen belt 160. In the latter case, the driver for the downstream-side conveyance route CR2 is reversed in the above-described Step S2204 so as to collect all the sheets being conveyed to the platen belt 160.

(Operations and Effects)

According to the second embodiment as described above, when a curl of a sheet is detected, the operations after the emergency stop of the register roller is changed depending on whether the curl occurs at the front end of the sheet or at the tail end. In this way, it is possible to prevent the head unit 110 and the curled portion of the sheet to come into contact with each other and thereby to protect the head unit 110. Moreover, it is possible to deal with various circumstances. For example, the printed sheets are discharged to a usual discharging route DR through a downstream-side conveyance route CR2 to prevent printed sheets from being wasted, or as to unprinted sheets, a printing process is brought to an emergency stop or the unprinted sheets are retreated into another route or the like to preferentially protect the recording head.

To be more precise, in the second embodiment, when the curl is detected at the front end of the sheet, it is possible to preferentially prevent the unprinted sheets from damaging the recording head of the image forming unit (head unit 110) by means of an emergency stop of the paper feed mechanism. Meanwhile, printed sheets, which are currently being printed, located on an image forming route CR1 and printed sheets, which have been already printed, located on the downstream-side conveyance route CR2 can be discharged via the common route CR as usual. Hence it is possible to prevent the sheets from being wasted.

On the other hand, when the curl is detected at the tail end of the sheet, the printing process is in progress on the sheet on the image forming route CR1 of which the curl is detected. Therefore, the sheet printed only partly is separated from the head unit 110 together with the image forming route CR1 by using the retreat mechanism to prevent the sheet from coming into contact with and damaging the head unit 110.

Moreover, in the second embodiment, if the curl detector detects the curl of the sheet, the sheet in the switchback route SR is discharged onto the retreated image forming route CR1 when the image forming route CR1 is retreated by the retreat mechanism. Accordingly, when there is a sheet trouble on the switchback route SR, the sheet that retains on the switchback route SR is conveyed to the platen belt 160 which is lowered in order to discharge the sheet. Hence it is possible to easily remove the sheet that retains in the switchback route SR having the complicated mechanism.

As described above, the second embodiment can prevent the sheet from striking against the recording head of the image forming unit by detecting whether the curl of the sheet is located at the front end or at the tail end. Moreover, the second embodiment can facilitate an operation to remove a jammed recording medium to be executed by a user if a recording medium is jammed somewhere on the conveyance route.

The transfer control mechanism for a printer and the transfer control method according to the embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiment of the present invention are only a list of optimum effects achieved by the present invention. Hence, the effects of the present invention are not limited to those described in the embodiment of the present invention.

What is claimed is:

1. A conveyance control mechanism for a printer provided with an image forming unit configured to form an image on a sheet being conveyed on a conveyance route, the conveyance control mechanism comprising:

a curl detector configured to detect a curl at either of a front end and a position other than the front end of a sheet in conveyance on the conveyance route, in an upstream of the image forming unit on the conveyance route;

a conveyance route controller configured to control drive and stop of the conveyance route, the conveyance route controller configured to drive and stop the conveyance route differently depending on whether the curl detector detects the curl at the front end of the sheet or at the position other than the front end of the sheet;

an image forming route included in the conveyance route, the image forming route being a place where the image forming unit performs an image formation;

a retreat mechanism configured to separate and retreat the image forming route from the conveyance route; and a discharge controller configured to switch a sheet discharge process for a sheet in conveyance on the conveyance route, the discharge controller configured to drive the retreat mechanism to retreat the image forming route and discharge a sheet in conveyance onto the retreated image forming route, when the curl detector detects the curl of the sheet.

2. The conveyance control mechanism according to claim 1, wherein the curl detector is configured to detect overlapped feed of sheets, and the discharge controller drives the retreat mechanism to retreat the image forming route when overlapped feed of sheets is detected by the curl detector.

3. The conveyance control mechanism according to claim 1, further comprising:

a conveyance route controller configured to control drive and stop of the conveyance route, wherein the conveyance route includes:

a common conveyance route continuing from a feeding route for feeding a sheet to a discharging route via the image forming unit; and a switchback route branched off and connected to the common conveyance route, the switchback route configured to reverse front and back surfaces of a sheet by receiving the sheet from the common conveyance route, reciprocating the sheet, and returning the sheet to the common conveyance route, and wherein when the retreat mechanism retreats the image forming route, the conveyance route controller discharges a sheet existed inside the switchback route onto the retreated image forming route.

4. A conveyance control method for a printer provided with an image forming unit configured to form an image on a sheet being conveyed on a conveyance route, the method comprising:

detecting a curl at either a front end and a position other than the front end of a sheet in conveyance on the conveyance route, in an upstream of the image forming unit on the conveyance route;

driving and stopping the conveyance route differently depending on whether the curl is detected in the step of detecting a curl at the front end of the sheet or at the position other than the front end; and when the curl of the sheet is detected in the step of detecting a curl, separating and retreating an image forming route from the conveyance route, and discharging a sheet in conveyance onto the retreated image forming route, the image forming route being included in the conveyance route and being a place where the image forming unit performs an image formation.

5. The conveyance control method according to claim 4, wherein overlapped feed of sheets is detected in the step of detecting a curl, and the image forming route is retreated in the step of retreating and discharging when overlapped feed of sheets is detected in the step of detecting a curl.

6. The conveyance control method according to claim 4, wherein the conveyance route includes:

a common conveyance route continuing from a feeding route for feeding a sheet to a discharging route via the image forming unit; and a switchback route branched off and connected to the common conveyance route, the switchback route configured to reverse front and back surfaces of a sheet by receiving the sheet from the common conveyance route, reciprocating the sheet, and returning the sheet to the common conveyance route, and wherein when the image forming route is retreated, a sheet existed inside the switchback route is discharged onto the retreated image forming route in the step of retreating and discharging.

* * * * *